United States Patent [19]

Reymont

[11] 4,313,488

[45] Feb. 2, 1982

[54] APPARATUS FOR GUIDING AND SUPPORTING A CONTINUOUSLY CAST SLAB

[75] Inventor: Bertrand Reymont, Zurich, Switzerland

[73] Assignee: Alfred Wertli Inc., Winterthur, Switzerland

[21] Appl. No.: 131,115

[22] Filed: Mar. 17, 1980

[30] Foreign Application Priority Data

Apr. 4, 1979 [DE] Fed. Rep. of Germany ..... 2913440

[51] Int. Cl.[3] ..... B22D 11/00

[52] U.S. Cl. ..... 164/448; 164/442; 193/35 R; 193/1; 198/779

[58] Field of Search ..... 164/442, 448, 82; 226/185, 189, 190; 193/35 R, 1; 198/472, 580, 779, 788

[56] References Cited

U.S. PATENT DOCUMENTS 3,283,368 11/1966 Homan ..... 164/442 X

FOREIGN PATENT DOCUMENTS 874967 4/1953 Fed. Rep. of Germany ..... 198/779
1082171 12/1954 France ..... 198/779
307966 1/1969 Sweden ..... 198/779

*Primary Examiner*—Gus T. Hampilos
*Attorney, Agent, or Firm*—Kenyon & Kenyon

[57] ABSTRACT

The freely rolling rolls are provided with distance wheels at the respective ends. Alternating rolls are provided with distance wheels which are fixedly mounted to the roll bodies while the remaining rolls are provided with distance wheels which are rotatably mounted on the roll bodies. The adjacent distance wheels are also provided with interengaging V-shaped grooves and projections for lateral stability of the rolls. The distance wheels provide for a constant uniform spacing of the rolls and maintain the rolls in parallel relation.

10 Claims, 4 Drawing Figures

APPARATUS FOR GUIDING AND SUPPORTING A CONTINUOUSLY CAST SLAB

This invention relates to an apparatus for guiding and supporting a continuously cast slab. More particularly, this invention relates to an apparatus for guiding and supporting a continuously cast slab of metal.

Heretofore, continuous casting installations have used various types of devices for guiding and supporting a slab during a casting operation particularly in that region of the slab which immediately follows a continuous chill mold and in which the slab is guided downwardly along a curved surface into a horizontal plane. As is known, the freshly cast hot slab must be cooled in this region in as uniform and effective a manner as possible and must be guided and supported securely so as to prevent deformation of the still soft slab. To this end, use is often made of a plurality of rollers which are journalled in fixed bearings along the path of the slap. Generally, these rollers are arranged to form a rear roller track and a front roller track between which the slab can be guided and supported. However, as the great heat of the slab is necessarily transferred to these rollers, this inevitably leads to problems in the support of the rollers. For example, failure of a bearing supporting a roller due to excessive heating has serious consequences because the entire installation must be stopped in order to replace the failed bearing.

Another extremely troublesome problem is bending of the rollers which are supporting (respectively containing) the casted slab. Due to Ferro-static pressure of a liquid core of the slab and to the fact that very hot crust of the slab is easily bulged to the outside due to this pressure, practically the whole Ferro-static pressure must be taken by the rollers. Since the fixed rollers are supported at the ends there where the bearings are located, a severe bending of the rollers is taking place. The Ferro-static pressure thus producing the force on one roller up to 160 metric tons. These enormous loads plus very high temperatures at which the rollers must work (up to 800° C.) are setting promptly the limitations to wide slab manufacturing, which otherwise is very advantageous economically for production of steel plates.

In order to overcome the above problems, it has been proposed in Austrian PS No. 342,802 to provide a plurality of freely rolling substantially cylindrical rolls for the rear support and guiding of the downwardly moving slab. As described, these rolls are intended to roll off a curved support surface disposed at the back of the slab. Such rolls require no bearings which could otherwise be destroyed and, as the back of the slab rolls on the rollers, every point on the slab surface remains accessible to the cooling water so that local overheating cannot occur.

However, although this construction appears to be successful in principle, there are two serious disadvantages. First, a constant distance between the individual rollers cannot be maintained. Second, the rollers are not always aligned exactly parallel with one another. In order to overcome these disadvantages, it is proposed in Austrian PS No. 342,802 to provide the circumferential surface of the rolls with guide grooves to run on guide rails on the support surface. However, it has been found that a parallel guiding of the rollers in a most exact manner cannot be achieved. In particular, with increasing use of the installation, the guide rails and the guide grooves wear very quickly, particularly under the influence of the high temperatures, so that the rolls may skew. This, in turn, leads to the ocurrence of powerful shearing forces and may even lead to the destruction of the slab. Further, maintenance of a uniform distance between the rollers during passage through the installation is not achieved. Specifically, although the rollers are to be introduced in a uniform manner from above onto a supporting surface under the slab and would be theoretically retained by a high compressive force, displacement may result due to an irregular formation of the slab. In the worst case, a roller which has just been introduced may fall down to the next roller. This, however, must be avoided at all costs.

Accordingly, it is an object of the invention to provide an apparatus for guiding and supporting a continuously cast slab on freely rolling rolls which are maintained at a uniform spacing and in exact parallel relationship.

It is another object of the invention to guide and support a continuously cast slab on freely rolling rolls without imparting excessive bending forces on the rolls.

It is another object of the invention to maintain the guide and support rolls for a continuously cast slab in parallel relation.

It is another object of the invention to transfer high compressive forces from a continuously cast slab through a plurality of freely rolling rolls to a support surface without significant frictional forces occurring.

Briefly, the invention is directed to an apparatus for guiding and supporting a continuously cast slab which is comprised of an elongated support surface and a plurality of rolls which are disposed on the support surface in freely rolling relation in order to guide the slab therealong. In accordance with the invention, each of the rolls has a distance wheel at each end in contact with a distance wheel on an adjacent roll. Also, each alternating roll has the distance wheels fixedly mounted thereon while the remainder of the rolls have the distance wheels rotatably mounted thereon via a rolling bearing.

In addition, the alternating distance wheels on each side of the rolls are each provided with a circumferential groove while the remaining wheels have a circumferential projection which engages in a groove of an adjacent distance wheel. These grooves and projections may each be of V-shape so as to interfit in a smooth manner within each other.

By providing the freely rolling rolls with distance wheels in the above manner, a constant distance or spacing between the rolls can be maintained. Further, an absolutely parallel position of the rolls with respect to each other can also be maintained. Because of these features, the tremendously high compressive forces exerted by the slab can be transferred through the rolls to the support surface without significant frictional forces occurring. Also, if the rolls are introduced positively until the distance wheels make contact, all the rolls will have a mutually uniform constant spacing during their entire passage through the apparatus. Thus, a parallel relationship is maintained between the individual rolls even if the slab should be uneven due to local shrinkage or other deformation.

Since the distance wheels of every other roll are freely rotatable, only minor frictional forces occur between the individual rolls. Hence, large shearing forces on the slab are avoided.

These and other objects and advantages of the invention will become more apparent from the following detailed description taken in conjunction with the accompanying drawings wherein:

FIG. 1 schematically illustrates a sectional view through a continuous casting installation employing a guiding and supporting apparatus in accordance with the invention;

Figure 1:
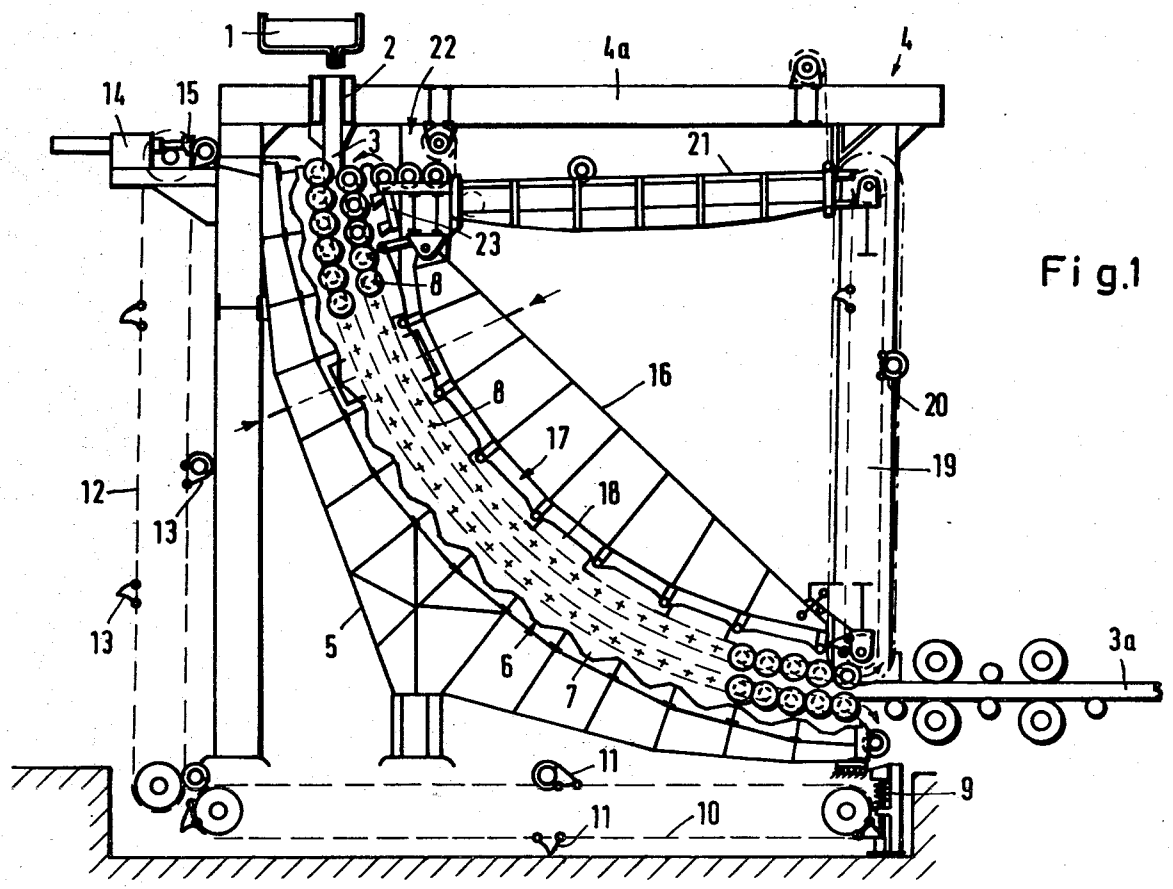

Referring to FIG. 1, the continuous casting installation includes a frame 4 which has an upper cross beam 4*a* which carries a chill mold 2 for receiving a liquid metal 1. The chill mold 2 serves to form a slab 3 of the metal which emerges at the lower end of the mold 2. The frame 4 also has an apparatus for guiding and supporting the continuously cast slab 3 in a curved path from a point below the mold 2 to a point at which the slab 3*a* becomes substantially horizontal as well as suitable means for cooling the slab 3 during passage along the curved path. Suitable rollers are provided at the end of the path so that the slab 3*a* which is fairly cool can be supplied to other equipment for subsequent processing.

Figure 2:
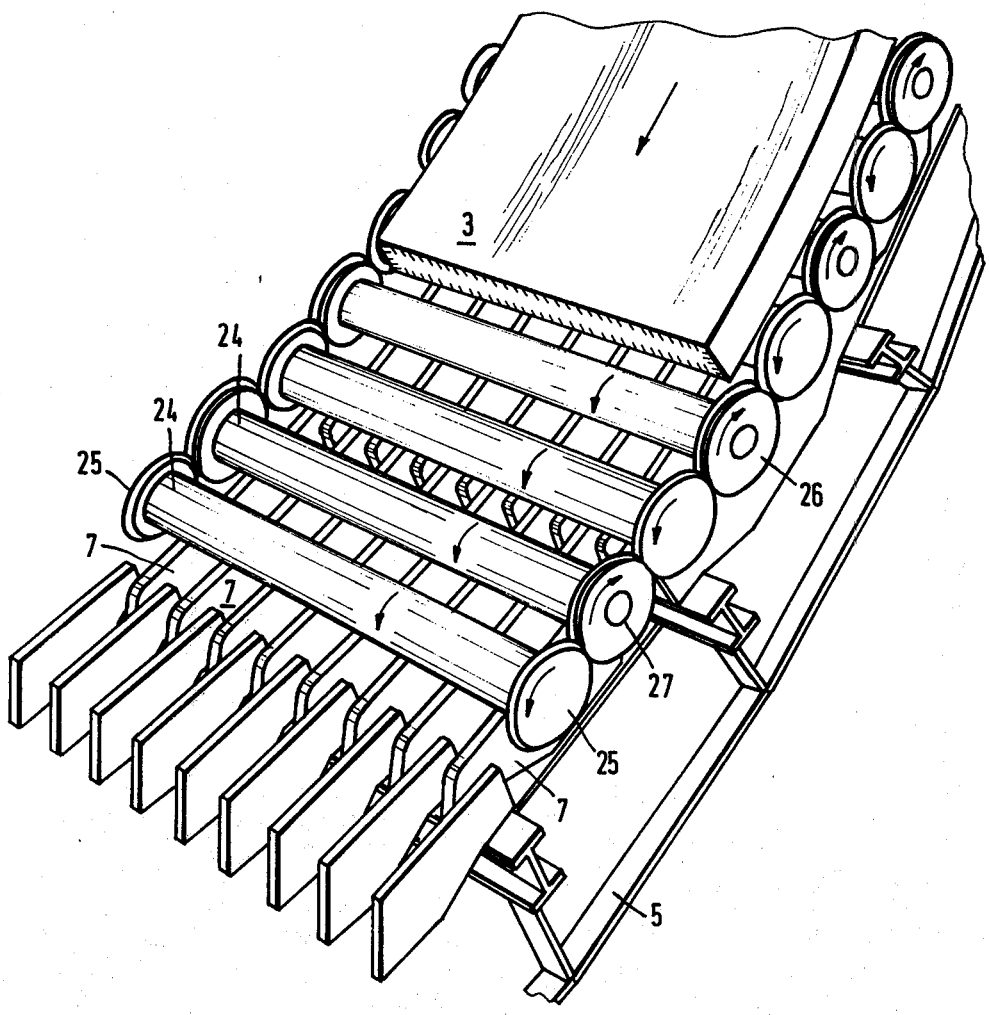
FIG. 2 illustrates a perspective view of a guiding and supporting apparatus according to the invention.

As shown, the apparatus for guiding and supporting the slab 3 includes a prop 5 which is firmly anchored on the frame 4 and carries an elongated support surface 6 directed towards the slab 3. The support surface 6 is curved in accordance with the curvature of the slab 3 and is composed of a plurality of laterally spaced support elements 7 (FIG. 2) which, in turn, have a plurality of rolls 8 disposed thereon in freely rolling relation in order to guide and support the slab 3 therealong. As shown in FIG. 2, the rolls 8 are cylindrical and extend transversely across and on the support elements 7 so that the load of the slab 3 can be transferred to the support elements 7. Further, the rolls 8 move freely downward without any suspension.

Figure 3:
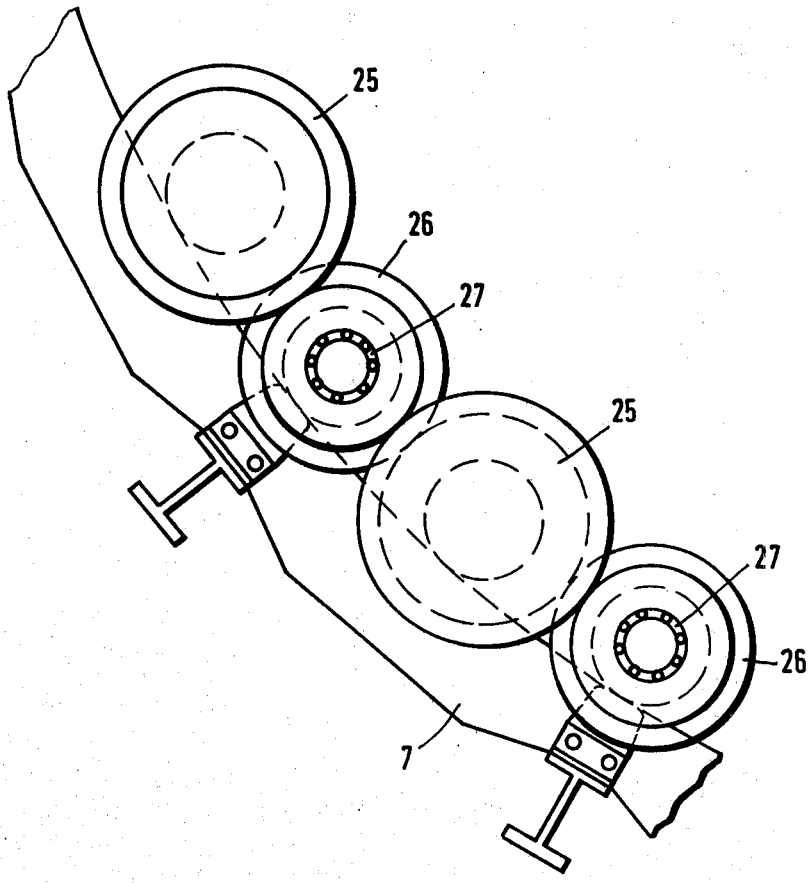
FIG. 3 illustrates a partial sectional view through a number of rolls of the guiding and supporting apparatus of the invention.
Figure 4:
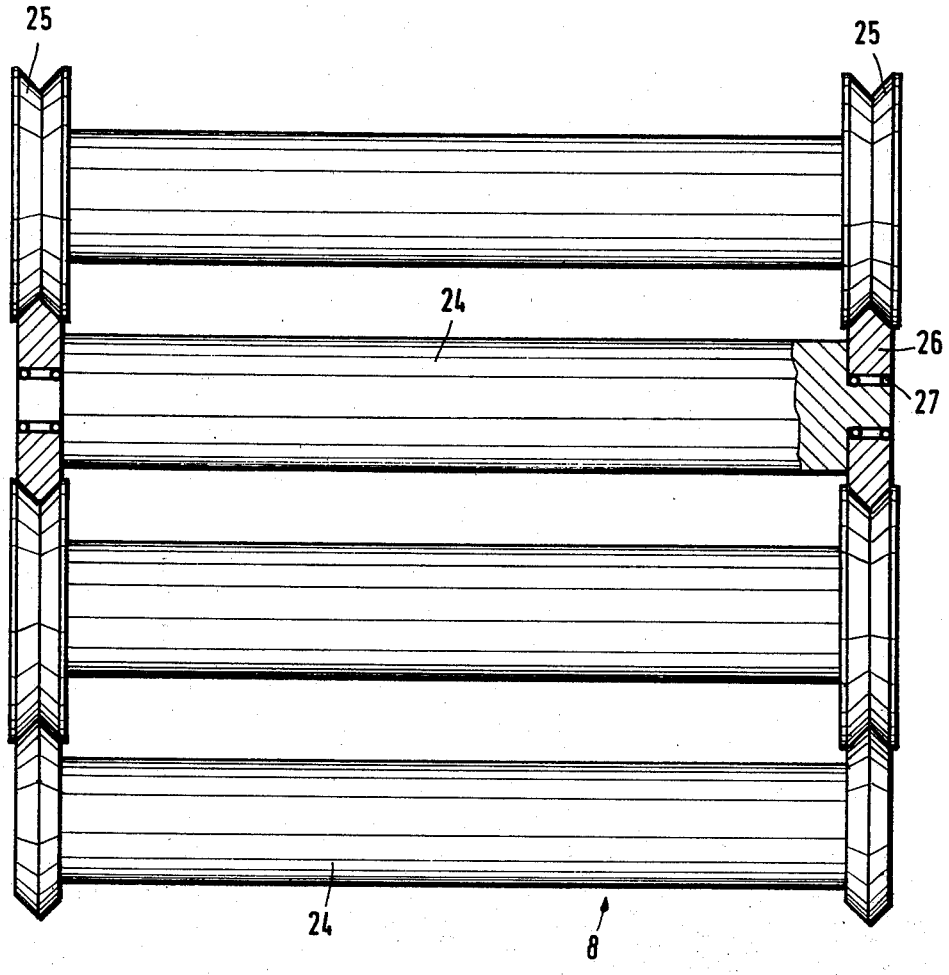
FIG. 4 illustrates a plan view of the rolls of FIG. 3 with a partial cross-section.

Referring to FIGS. 2 to 4, each roll has a central roll body 24 which is substantially of cylindrical shape and may be formed, for example, by a cylindrical steel tube. In addition, each end of each roll 8 has a guide wheel 25,26 thereon. As indicated, each of the alternating rolls 8 has guide wheels 25 fixedly mounted on a respective end of the roll body 24 while the remainder of the rolls 8 have guide wheels 26 rotatably mounted on a respective end of the roll body 24 via a rolling bearing 27. The fixedly mounted guide wheels 25 are provided with V-shaped circumferentially grooves (see FIG. 4) while the rotatably mounted wheels 26 are provided with a circumferential projection of V-shape. As indicated in FIGS. 3 and 4, the respective grooves and projections of the adjacent wheels 25,26 engage in each other in a mating relationship.

The construction of the guide wheels 25,26 insures that pairs of adjacent rolls 8 are positively connected in alternating manner. Further, the V-shape of the mating grooves and projections of the guide wheels 25,26 provide a centering effect to secure the parallel position of rolls 8 with respect to each other at a constant uniform mutual spacing from each other.

Referring to FIG. 1, during operation, the downwardly-moving slab 3 rolls along the surfaces of the roll body 24 of each roll 8 on the support surface 6 while the roll bodies 24 roll along the support elements 7. Each individual roll 8 thus moves at a certain relative velocity to the slab 3 during downward travel. Upon reaching the lower end of the support surface 6, each roll 8 falls out of the interspace between the top of the support elements 7 and the back of the slab 3. Each roll 8 is then recycled by a suitable means back to the upper end of the support surface 6. This means includes a catch device 9, a horizontal conveyor belt 10 with drivers 11, a second conveyor belt 12 provided with drivers 13 and an insertion device 14 equipped with a ram 15. The catch device 9 is disposed to catch a falling roll 8 and to position the roll 8 onto the conveyor belt 10. The drivers 11 on the conveyor belt 10 are disposed at predetermined distances as a function of the circumferential speed of the conveyor belt 10 so as to convey each roll 8 to the vertically disposed conveyor belt 12. The drivers 13 on the conveyor belt 12 serve to carry each roll upwardly to the insertion device 14. Upon actuation of the ram 15, a roll 8 which has been positioned by the conveyor belt 12 in front of the ram 15, is shifted horizontally into a interspace between the support elements 7 and the back of the slab 3 from above. The inserted roll 8 then rolls down the support surface 7 and the cycle begins anew.

As shown in FIG. 1, the front face of a slab 3 is supported and guided in a similar manner. To this end, the frame 4 has a carrier 16 mounted therein in known manner. The carrier 16 is provided with a curved support surface 17 which faces the support surface 6 and has a plurality of laterally spaced support elements 18 thereon. In addition, a second set of rolls 8 is disposed on the support elements 18 in freely rolling relation to guide the slab 3 therealong. These rolls 8 serve to transfer the force exerted by the slab 3 on the carrier 16 to the support elements 18. The rolls 8 on the support elements 18 are of the same construction as the rolls 8 which roll on the support elements 7 and need not be further described.

As above, a means is provided for recycling the rolls 8 to and from the support surface 17. This means includes a vertical conveyor belt 19 with drivers 20, an inclined plane 21, a waiting station 22 and an insertion member 23. During operation, the rolls 8 move with the advance of the slab 3 in the downward direction indicated. As each roll moves off the support elements 18 into a space between the elements 18 and the slab 3, the drivers 20 on the conveyor belt 19 carry the roller 8 upwardly to the inclined plane 21. Each roll 8 then moves down the inclined plane 21 to the waiting station 22. As soon as a new roll 8 is required between the slab 3 and the support elements 18, the insertion member 23 is actuated by a suitable mechanism (not shown) so as to introduce the foremost roll 8 on the inclined plane 21 into an interspace between the slab 3 and the support elements 18. The roll 8 then moves downwardly along the support elements 18.

Referring to FIG. 2, as illustrated by the arrows on the roll bodies 24, all the rolls 8 on the back of the slab 3 and all the rolls 8 on the front of the slab 3 rotate in the same direction when the slab 3 is being moved through the installation toward the lower right as viewed in FIG. 1. By equipping every other roll with rotatable guide wheels 26, a rigid arrangement of the guide wheels is avoided along with the large frictional forces which would otherwise occur between adjacent guide wheels. Instead, the rotatable wheels 26 permit a free unhindered rotation of every other guide wheel 26 in the opposite direction. The bearings 27 thus need to absorb only comparatively small forces with a simultaneous relatively slow rotation. Thus, the life of the bearings 27 is sufficiently long even at the high temperatures which occur during the casting of a slab 3.

Should a lateral displacement of a roll 8 occur due to irregularities on the surface of the slab 3, this is corrected at once due to the complementary V-shaped circumferential surfaces of the guide wheels 26,27 being in contact with each other. Thus, rolls 8 have a greater lateral stability during passage through the apparatus.

It is to be noted that the individual rolls 8 can be manufactured at low cost. This is an important factor as a large number of such rolls are needed in a continuous casting installation. Should one of the rolls show any damage, replacement for a new intact roll can be effected during its return on the conveyor belts 10, 12, 19 without having to stop the entire continuous casting installation.

Note is made that the advance of the slab 3 toward the lower right as illustrated in FIG. 1 is not described in detail since such is well-known.

What is claimed is:

1. An apparatus for guiding and supporting a continuously cast slab comprising an elongated support surface, and a plurality of rolls disposed on said support surface in freely rolling relation to travel along said support surface and to guide a slab therealong, each said roll having an axis of rotation perpendicular to the direction of travel along said support surface and having a distance wheel with an axis of rotation coextensive with said axis of rotation of said roll mounted at each end of each roll in contact with a distance wheel of an adjacent roll, said distance wheels of each alternating roll being fixedly mounted thereon and non-rotatable relative to their associated alternating roll and the remainder of said rolls having said distance wheels rotatably mounted thereon for rotation relative to their associated roll.

2. An apparatus as set forth in claim 1 which further comprises a rolling bearing mounting each respective rotatably mounted distance wheel on a respective roll.

3. An apparatus as set forth in claim 1 wherein alternating distance wheels on each side of said rolls each have a circumferential groove therein and the remaining wheels have a circumferential projection engaging in said groove of an adjacent distance wheel.

4. An apparatus as set forth in claim 1 wherein each said groove is V-shaped and each said projection is V-shaped.

5. An apparatus for guiding and supporting a continuously cast slab comprising a frame;

a curved support surface disposed in said frame and having a plurality of laterally spaced support elements thereon; and a plurality of rolls disposed on said support elements in freely rolling relation to travel along said support support surface and to guide a slab therealong, each of said rolls having an axis of rotation perpendicular to the direction of travel along said support surface and a pair of distance wheels with axes of rotation coextensive with said axis of rotation of said roll mounted one on a respective end thereof, each alternating roll of said rolls having said pair of distance wheels thereon fixedly mounted on a respective end thereof and being non-rotatable relative to their associated alternating roll and the remainder of said rolls having said pair of distance wheels thereon rotatably mounted on a respective end thereof for rotation relative to their associated roll.

6. An apparatus as set forth in claim 5 which further comprises means associated with said frame for recycling rolls exiting said support surface to an entrance to said support surface.

7. An apparatus as set forth in claim 5 wherein alternating distance wheels on each side of said rolls each have a circumferential groove therein and the remaining wheels have a circumferential projection engaging in said groove of an adjacent distance wheel.

8. An apparatus as set forth in claim 5 which further comprises a second support surface facing said first support surface and having a plurality of laterally spaced support elements thereon, and a second plurality of rolls disposed on said support elements of said second support surface in freely rolling relation to travel along said support support surface and to guide a slab therealong, each of said second plurality of rolls having an axis of rotation perpendicular to the direction of travel along said support surface and a pair of distance wheels with axes of rotation coextensive with said axis of rotation of said roll mounted one on a respective end thereof, each alternating roll of said second plurality of rolls having said pair of distance wheels thereon fixedly mounted on a respective end thereof and being non-rotatable relative to their associated alternating roll and the remainder of said second plurality of rolls having said pair of distance wheels thereon rotatably mounted on a respective end thereof for rotation relative to their associated roll.

9. An apparatus as set forth in claim 8 which further comprises means associated with said frame for recycling rolls of said second plurality of rolls exiting said second support surface to an entrance to said second support surface.

10. An apparatus as set forth in claim 5 wherein each said roll is cylindrical.

* * * * *

UNITED STATES PATENT AND TRADEMARK OFFICE

CERTIFICATE OF CORRECTION

PATENT NO. : 4,313,488

DATED : February 2, 1982

INVENTOR(S) : BERTRAND REYMONT

It is certified that error appears in the above—identified patent and that said Letters Patent is hereby corrected as shown below:

Column 1, line 20, change "slap" to --slab--

Column 2, line 3, change "ocurrence" to --occurrence--

Column 6, line 6, before "surface" cancel "support"

Column 6, line 35, cancel "support" (first occurrence)

Signed and Sealed this

*Twenty-fifth* Day of *May 1982*

[SEAL]

*Attest:*

GERALD J. MOSSINGHOFF

*Attesting Officer*

*Commissioner of Patents and Trademarks*